United States Patent [19]

Brunner

[11] 4,052,586

[45] Oct. 4, 1977

[54] WATER-JET ELECTRODE STEAM GENERATOR AND ELECTRODE THEREFORE

[75] Inventor: Alfred Brunner, Winterthur, Switzerland

[73] Assignee: Sulzer Brothers Limited, Winterthur, Switzerland

[21] Appl. No.: 634,059

[22] Filed: Nov. 21, 1975

[30] Foreign Application Priority Data

Nov. 26, 1974 Switzerland ..... 15656/74

[51] Int. Cl.[2] ..... H05B 3/60; F22B 1/30

[52] U.S. Cl. ..... 219/284; 219/288; 219/291; 338/80

[58] Field of Search ..... 219/284–295, 219/271–276; 338/80–86

[56] References Cited

U.S. PATENT DOCUMENTS

| | | | |
|---|---|---|---|
| 3,688,077 | 8/1972 | Williams | 219/284 |

FOREIGN PATENT DOCUMENTS

| | | | |
|---|---|---|---|
| 632,231 | 7/1936 | Germany | 219/288 |
| 685,856 | 12/1939 | Germany | 219/284 |
| 89,379 | 6/1937 | Sweden | 219/288 |
| 207,778 | 2/1940 | Switzerland | 219/288 |
| 613,349 | 11/1948 | United Kingdom | 219/285 |

*Primary Examiner*—A. Bartis

*Attorney, Agent, or Firm*—Kenyon & Kenyon, Reilly, Carr & Chapin

[57] ABSTRACT

The steam generator is provided with electrodes each of which is constructed with at least one longitudinally slotted tube into which a plate is placed in order to deflect incoming water from a central source tangentially into the tube. The deflecting plate is secured against one side of the slot and projects into the electrode tube to form an opening into the tube interior and has a free end within the tube. A trough collects excess water below the plate for delivery into the tube. The delivered water flows in a helical path within the tube while being heated to steam. The water discharge nozzles in the base of the electrode are partitioned so that water flows continuously and evenly from the electrode to prevent arcing below the electrode.

11 Claims, 5 Drawing Figures

Figure 1:
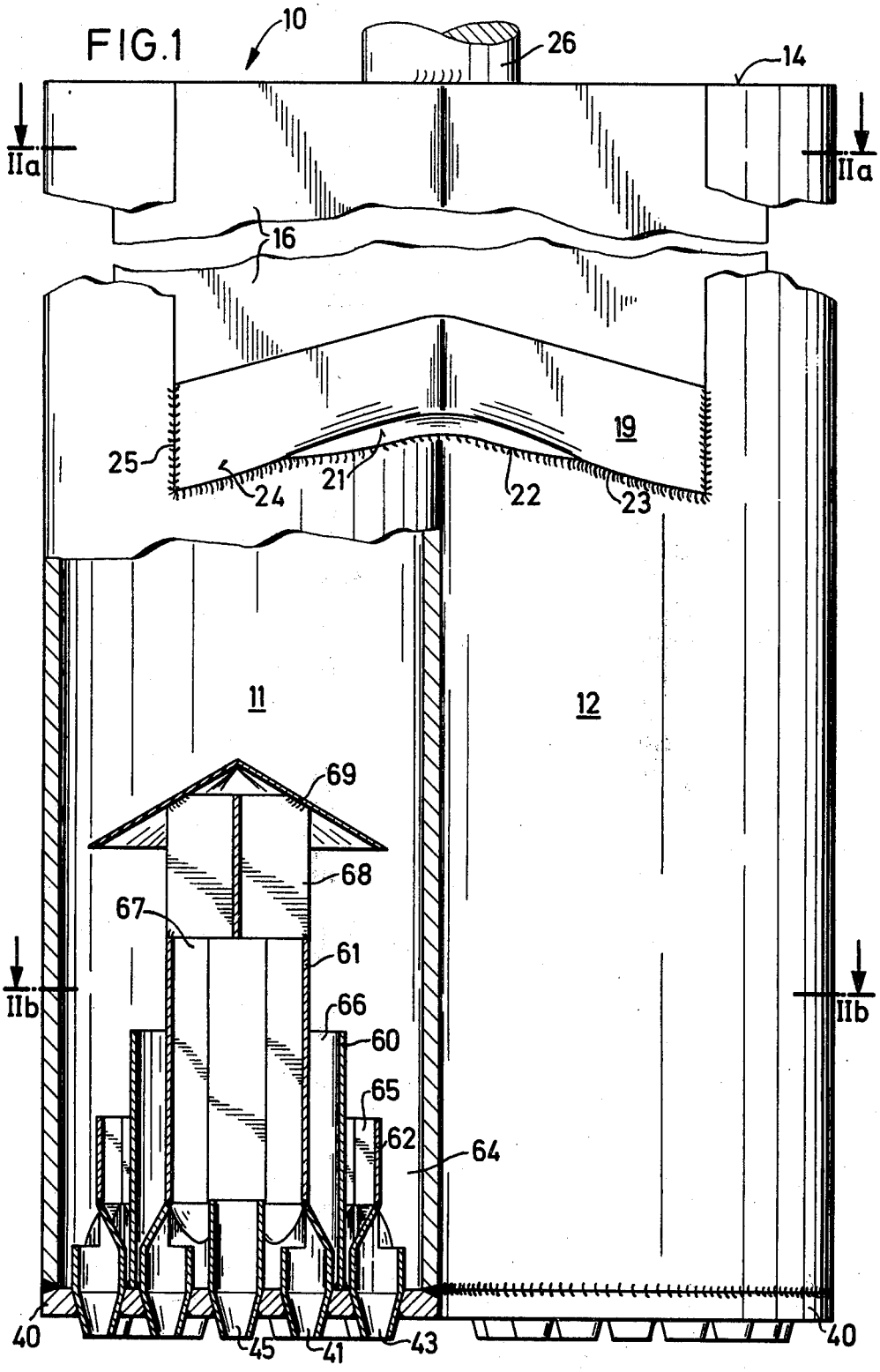

10
26
14
IIa
IIa
16
19
25
24
21
22
23
11
12
69
68
67
61
IIb
IIb
66
60
65
62
64
40
45
41
43
40

WATER-JET ELECTRODE STEAM GENERATOR AND ELECTRODE THEREFORE

This invention relates to an electrode for a water jet electrode steam generator.

As is known, steam generators of the water-jet electrode type employ electrodes which have a collecting box into which water flows in jets or streams from a distributor. During use, the delivered water is heated to produce steam which is drawn off and the unevaporated water leaves the collecting box and, possibly travelling by way of a second electrode, drops back to the water supply. Usually, the amount of steam generated is controlled by controlling the number of water jets or streams which issue from the distributor to the first-mentioned electrode.

In order to function in an acceptable manner, it is important that the steam be separated rapidly from the water flowing through the electrode. It is also important to have the water flow away from the electrode in an orderly fashion, otherwise there may be disturbing arcing in the region between the two electrodes. Arcing occurs particularly when the number of water jets directed onto the first electrode is reduced so that the water does not leave the electrode in the form of a closed, i.e., continuous flow.

Accordingly, it is an object of the invention to provide an electrode of the kind specified such that steam is separated from the water rapidly.

It is another object of the invention to eliminate the possibility of arcing in a water-jet electrode steam generator during partial-load operation.

It is another object of the invention to provide a simple electrode construction for a water-jet electrode steam generator which is able to provide for increased efficiency.

Briefly, the invention provides an electrode for a water-jet electrode steam generator which comprises a water-collecting box including at least one tube which has a longitudinally disposed slot in a wall thereof for passage of a flow of water into the tube, and a deflecting plate which extends through the slot into the tube in order to deflect the flow of water tangentially into the tube.

The deflection of the incoming water allows the water and resulting steam-water mixture to swirl within the tube in a helical path. This, in turn, allows for an improved separation of the steam from the water as well as separation of small water droplets from the steam.

The water-collecting box further includes a base which is connected to the tube and in which a plurality of water discharge nozzles are placed. In addition, a plurality of partitions are secured to the nozzles on an inlet side thereof to define a plurality of annular chambers. Preferably, the axes of the nozzles are disposed on at least one circle through which one of the partitions extends, the nozzles of any circle communicating through communicating walls alternately with the annular chamber on one side and with the annular chamber on the other side. The inner partitions can also terminate at a higher elevation than the outer partitions.

The deflecting plate is also provided at its bottom end with an inclined passage whose lower end is connected to the tube in order to deliver undeflected water into the tube.

According to another feature of the invention, each electrode may be in the form of two tubes which, in plan, are arranged in mirror image symmetry, and the two deflecting plates abut one another V-fahsion.

Figure 2A:
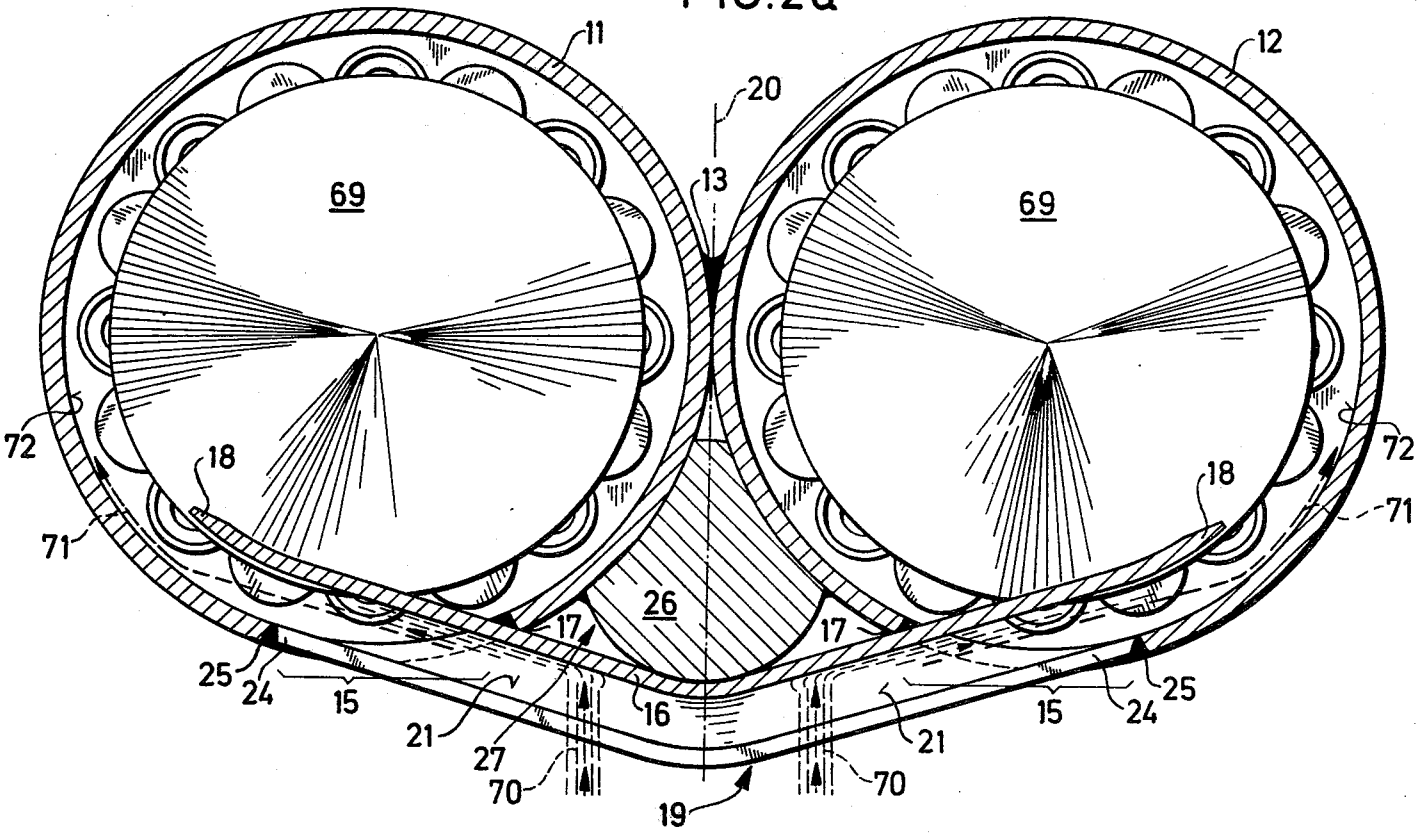
Figure 2B:
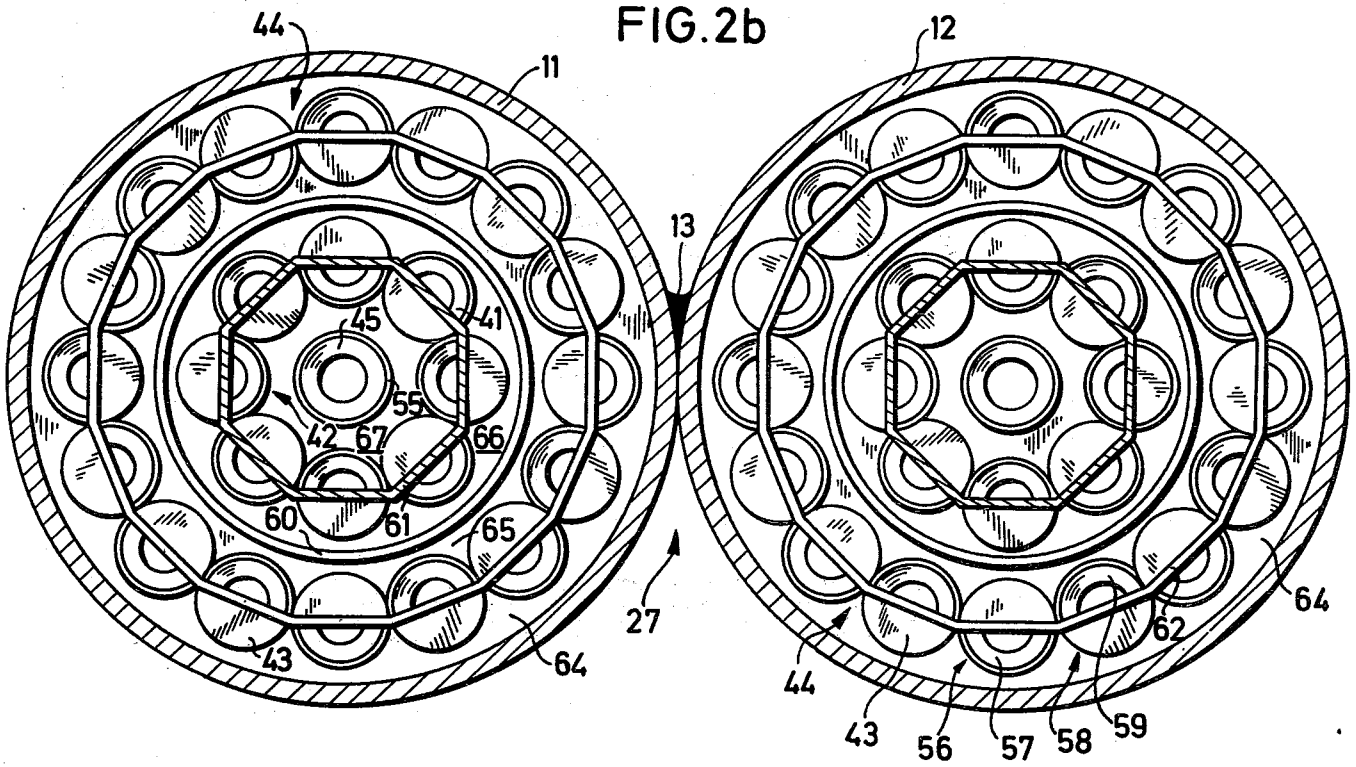
Figure 3:
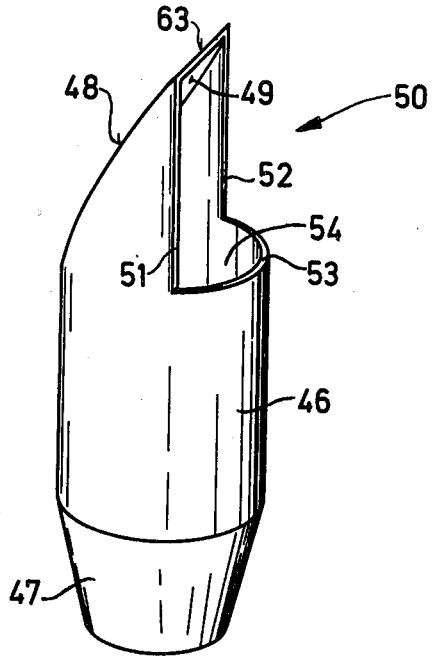
Figure 4:
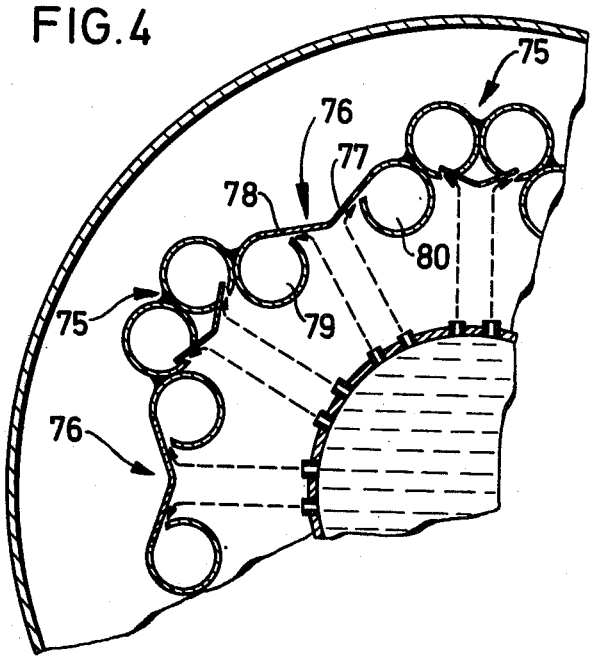

These and other objects and advantages of the invention will become more apparent from the following detailed description and appended claims taken in conjunction with the accompanying drawings in which:

FIG. 1 illustrates a longitudinal section through an electrode according to the invention;

FIG. 2*a* illustrates a view taken on line II*a*–II*a* of FIG. 1;

FIG. 2*b* illustrates a view taken on line II*b*—II*b* of FIG. 1;

FIG. 3 illustrates a perspective view of a discharge nozzle according to the invention; and FIG. 4 illustrates a partial cross-sectional view of a water-jet electrode steam generator constructed in accordance with the invention.

Referring to FIGS. 1 and 2*a*, an electrode 10 for a water-jet electrode steam generator includes a water-collecting box in the form of a pair of parallel tubes 11, 12 which are welded together at the region 13 where the tubes 11, 12 contact each other. The tubes 11, 12 are arranged so that the respective longitudinal axes are vertically disposed. The tubes 11, 12 serve to receive water supplied in streams or jets to the electrode from a suitable supply means (not shown). Each tube 11, 12 is formed with a vapor outlet at the upper end, a water outlet in the bottom and a slot 15 in the wall which slot extends parallel to the longitudinal axis of the respective tube from the top edge 14 of the tube and which terminates in an angular manner in the bottom region of the tube above the water outlet. A V-shaped deflecting plate 16 is introduced downwardly into the two apertures or slots or the like 15 and is welded at the inner slot edges 17 to the two tubes 11, 12. The two arms of plate 16 are slightly bent and pointed at their ends 18 (FIG. 2*a*). Alternatively, two separate plates may be used which are welded together in V-shaped manner with each plate being secured to a respective tube. The plate is disposed to deflect a flow of water which impinges thereon into the respective tubes 11, 12 and tangentially onto the walls of the tubes 11, 12. As shown, the plate 16 is mounted in sealed relation to one side of the slot 15 and is disposed to pass between the center of the respective tube 11, 12 and the opposite side of the slot to form a free opening. Thus, the plate has a free end located within the respective tubes 11, 12 downstream of the flow of water.

At the bottom end of plate 16 there is a trough or channel or the like 19 which descends symmetrically on both sides from the center-plane 20 of the two tubes 11, 12. One arm 21 of an angle-member forming such trough or channel is welded to the bottom end of the deflecting plate 16 along a line 22 and is welded to terminal edges of the slots 15 in the tubes 11, 12 along a line 23. The other arm 24 of the angle member 19 is welded along a line 25 to the bottom region of the outer edge of the slots 15 in the tubes 11, 12.

A pin 26 is introduced into a gusset 27 at the top end of the electrode 10 between the two tubes 11, 12 and the plate 16 and is welded thereto. Each of the two tubes 11, 12 forming the electrode is secured to a base or bottom member 40, each receiving (25) discharge nozzles 41 which define the water outlet. Eight of the nozzles 41 form an inner ring or row 42 and sixteen nozzles 43 form an outer ring or row 44 and the 25 nozzle 45 is disposed at the center of the base 40. These nozzles 41 are disposed in the base 40 to discharge water and cooperate with a plurality of tubular partitions 60, 61, 62 which are secured to the nozzles on an inlet side to define a plurality of annular chambers.

Referring to FIG. 3, each nozzle 41 disposed in the annular rows 42, 44 has a tubular portion 46 and a conical portion 47. The tubular portion 46 has a bevelled initial portion 48 which is covered by a covering portion 49; the tubular portion 46 is also formed with a cut-out 50 defined by three cutting edges 51, 52, 53 which bound a discharge orifice 54 for water discharging from the collecting box. The edges 51, 52 of adjacent nozzles are welded together in seal-tight manner (FIG. 2*b*). The central nozzle 45 also has a tubular portion 55; however, unlike the other nozzles, the central nozzle 45 has no portions corresponding to the portion 48 and cut-out 50. The nozzles 41 are so disposed in the two rings 42, 44 that their entry orifices face alternately towards the inside and towards the outside; for instance, the entry orifice 57 of nozzle 56 in ring 44 faces outwards and the entry orifice 59 of the next nozzle 58 faces inwards.

The tubular partition 60 is provided between the two nozzle rings 42, 44 and is connected to the base 40. The cylindrical partitions 61, 62 are of polygonal cross-section (FIG. 2*b*) and extend above the two nozzle rings 42, 44. The top edges 63 of the covering portions 49 of the nozzles in the two rings 42, 44 are connected in sealing-tight manner to the bottom edges of the partitions 61, 62 respectively. In this way, the axes of the nozzles in each ring 42, 44 are disposed in the plane of a respective partition 61, 62. The partitions 62, 60, 61 bound three coaxial annular chambers 64, 65, 66 and one central cylindrical chamber 67. Consequently, the entry orifices of the nozzles forming the outer nozzle ring 44 are disposed alternately in the annular chambers 64, 65. Similarly, the entry orifices of the nozzles in the inner ring 42 are disposed alternately in the annular chamber 66 and in the central chamber 67. A cruciform sheet-metal member 68 is disposed on the partition 61 which, in turn, supports a conical roof-like or top member 69.

In operation, water for evaporation impinges on the plate 16 in a strong stream or jets 70, is deflected by the plate 16 and is directed laterally through the slots 15 tangentially into the tubes 11, 12. The water flows therethrough on a substantially helical path 71 along the inner wall 72 and towards the base 40 of the collecting box. Since the movement of the water flowing along the inside walls of the tubes 11, 12 is a rotating flow, there is a considerable improvement in the separation of steam from the water. The steam which has been separated out from the water rises inside the tube, and since the steam is also rotating, drops of water are separated out from the steam. The steam therefore reaches its load in a very dry state. If a tube 11, 12 is of adequate length, the tangential component of the water flow is so slight that the water discharges from the tube in the form of a mist.

In the case where the base 40 has discharge nozzles, the water initially backs up in the annular chamber 64 and flows through those nozzles of the outer ring 44 whose entry orifices are disposed in the annular chamber 64. If, in view of the height of partitions 62, the cross-section of the latter nozzles is insufficient to discharge the water which has been supplied to the electrode, the water overflows over the partition 62, enters the next annular chamber 65 and also flows through those nozzles of ring 44 whose entry orifices are disposed in chamber 65. If the total cross-section of the latter nozzles is inadequate, the water floods over wall 60 and discharges by way of those four nozzles of ring 42 whose entry orifices are in chamber 66. At full load, the water floods over wall 61 and enters the cylindrical chamber 67, and discharge through the remaining four nozzles in the inner ring 42, the entry orifices of the latter nozzles being disposed in the central chamber 68, and through the central nozzle 45. The function of the roof-like member 69 is to ensure that there is no uncontrolled arrival of water — i.e., in a manner other than the manner described — e.g., in the form of droplets, to the nozzles, so that there is no risk of intermittent flows forming.

Consequently, the number of nozzles flowed through by water increases as the load of the steam generator increases — i.e., as the number of jets or streams of water applied to the electrode increases — until on full-load all the nozzles are participating in the discharge of water from the collecting box. The water-conveying nozzles convey water completely to the extent determined by their flow cross-sections. Consequently, there is no chance of water discharging at partial load intermittently from a number of nozzles in the manner likely to cause arcing below the electrode. As a result, the electrode current introduced via the electrode is distributed uniformly amongst the streams or jets of water flowing away from the electrode.

Referring to FIG. 4, the water-jet electrode steam generator may be provided with a mixed arrangement of electrodes 75, as hereinbefore described, and electrodes 76 similar to the above having deflecting plates 77, 78 disposed on the back of the tubes 79, 80 respectively. As shown, the electrodes 75, 76 are disposed in a circumferential array about a suitable means which directs jets of water onto each deflecting plate. In addition, the tubes of each electrode are disposed in pairs with the deflecting plates of each pair disposed alternately to the inside and outside of the array. As FIG. 4 shows, with this mixed arrangement, a number of electrodes can be nested one in another on a relatively small circle, particularly if the electrodes do not have to be electrically isolated from one another. Consequently, the pressure vessel 81 of the steam generator can be reduced in size.

In accordance with the invention, the electrode described can be embodied by a single tube instead of by two tubes, in which event of course the deflecting plate needs only one arm. Further, the number of nozzle rings is not limited to two and can be one or more than two.

What is claimed is:

1. An electrode for a water-jet electrode steam generator comprising a water-collecting box including at least one vertically disposed cylindrical tube having a vapor outlet in upper portion, a water outlet at a bottom thereof and a slot in a wall thereof for passage of a flow of water into said tube; and each said tube having a deflecting plate extending through said slot and disposed to deflect a flow of water impinging thereon into said tube and tangentially of said wall, said plate being mounted in sealed relation to one side of said slot and disposed to pass between the center of said tube and the opposite side of said slot to form a free opening, said plate having a free end located within said tube downstream of the flow of water.

2. An electrode as set forth in claim 1 wherein said water-collecting box further includes a base connected to each said tube bottom, a plurality of water discharge nozzles in said base, each said nozzle having an inlet side in communication with the interior of said tube for discharging water from said tube, and a plurality of partitions coaxial to said tube to define a plurality of annular chambers on said inlet side of said nozzles, each said chamber including at least one of said nozzles therein and said chambers being open at the upper end for communication with each other.

3. An electrode as set forth in claim 2 wherein said partitions define a plurality of concentric chambers, said partitions terminating at a higher elevation with decreasing diameter.

4. An electrode as set forth in claim 2 wherein said partitions are secured at the lower end thereof to said nozzles on said inlet side thereof.

5. An electrode as set forth in claim 4 wherein said partitions and at least some of said nozzles are disposed in concentric annular rows with the axes of each nozzles in a respective row being disposed in the plane of a respective partition, and wherein said nozzles in a respective row communicate alternately with said annular chambers on opposite sides of said respective partition.

6. An electrode as set forth in claim 1 wherein said plate includes a trough at a lower end connected to said tube to deliver undeflected water into said tube, said trough being open and inclined toward said free end of said plate.

7. An electrode as set forth in claim 1 wherein said water-collecting box includes a pair of said tubes mounted in parallel relation and the deflecting plates of said tubes being secured in a V-shaped manner externally of said tubes with each plate being secured to a respective tube.

8. An electrode as set forth in claim 1 wherein said plate includes a trough adjacent a lower end thereof and connected to said tube to deliver that portion of the water into said tube which has not been deflected by said plate into said tube, said trough opening and inclining toward said free end of said plate.

9. An electrode for a water jet electrode steam generator comprising at least one cylindrical tube defining a water collecting chamber having a vertically disposed longitudinal axis, each said tube having a vapor outlet in an upper portion, a water outlet in a bottom thereof, and a longitudinally disposed slot in a wall thereof between said outlet and bottom for entry of water into said chamber; and each said tube having a deflecting plate extending through said slot into said tube, and having a free end within said tube, said plate being disposed to deflect a jet of water impinging on said plate into said chamber and onto said wall tangentially of said axis.

10. An electrode as set forth in claim 9 which furthr comprises a base secured to each said tube at a lower end thereof, a plurality of annularly disposed rows of nozzles mounted in said base to define said water outlet, each said nozzle having an inlet in communication with said chamber for discharging water from said chamber, and a plurality of circumferential partitions secured to said nozzles to define a plurality of concentric annular chambers with each concentric chamber communicating with respective ones of said nozzles, each partition being secured to said respective annular row of said nozzles.

11. In a water-jet electrode steam generator, the combination of a circumferential array of electrodes for heating water to steam, each said electrode including at least one cylindrical tube defining a water collecting chamber having a vertically disposed longitudinal axis, said tube having a vapor outlet in an upper end, a water outlet in a bottom thereof and a longitudinally disposed slot in a wall thereof above said bottom for entry of water into said chamber;

a plurality of deflecting plates, each said plate extending through a respective slot of a respective tube with at least a number of said plates having a free end in a respective tube, each said plate being disposed to deflect a jet of water impinging on said plate into a respective chamber and onto said respective wall tangentially of said axis; and means within said array of electrodes for directing jets of water onto each respective plate.

* * * * *

UNITED STATES PATENT AND TRADEMARK OFFICE

CERTIFICATE OF CORRECTION

PATENT NO. : 4,052,586

DATED : October 4, 1977

INVENTOR(S) : Alfred Brunner

It is certified that error appears in the above-identified patent and that said Letters Patent are hereby corrected as shown below:

Col. 2, line 63, insert --twenty-five--before (25).

Col. 2, line 66, insert --twenty-fifth--instead of "25".

Col. 4, line 6, change "discharge" to --discharges--.

Col. 6. line 14. change "furthr" to -- further --.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*